US012287186B2

(12) United States Patent
Tan et al.

(10) Patent No.: US 12,287,186 B2
(45) Date of Patent: Apr. 29, 2025

(54) SAFE-AND-ARM DEVICE

(71) Applicant: ST ENGINEERING ADVANCED MATERIAL ENGINEERING PTE. LTD., Singapore (SG)

(72) Inventors: Yong Peng Tan, Singapore (SG); Soo Chew Sie, Singapore (SG); Siwei Huang, Singapore (SG)

( * ) Notice: Subject to any disclaimer, the term of this patent is extended or adjusted under 35 U.S.C. 154(b) by 0 days.

(21) Appl. No.: 18/574,051

(22) PCT Filed: Jun. 29, 2022

(86) PCT No.: PCT/SG2022/050453
§ 371 (c)(1),
(2) Date: Dec. 25, 2023

(87) PCT Pub. No.: WO2023/277816
PCT Pub. Date: Jan. 5, 2023

(65) Prior Publication Data

US 2024/0230298 A1 Jul. 11, 2024

(30) Foreign Application Priority Data

Jun. 29, 2021 (SG) ..... 10202107146V

(51) Int. Cl.
*F42C 15/192* (2006.01)
*F42C 9/02* (2006.01)
(Continued)

(52) U.S. Cl.
CPC ..... *F42C 15/188* (2013.01); *F42C 9/02* (2013.01); *F42C 15/192* (2013.01); *F42C 15/21* (2013.01); *F42C 15/26* (2013.01); *F42C 15/34* (2013.01)

(58) Field of Classification Search
CPC ..... F42C 9/02; F42C 15/188; F42C 15/192; F42C 15/196; F42C 15/20; F42C 15/21; F42C 15/24; F42C 15/26; F42C 15/34
(Continued)

(56) References Cited

U.S. PATENT DOCUMENTS 2,664,822 A * 1/1954 Hale ..... F42C 9/14 102/271
3,326,131 A * 6/1967 Hazelet ..... F42C 15/192 102/245
(Continued)

FOREIGN PATENT DOCUMENTS

CN 107144186 A 9/2017
WO WO-2023277816 A2 * 1/2023 ..... F42C 15/192

OTHER PUBLICATIONS

ISR; Intellectual Property Office of Singapore; Jan. 12, 2023.

*Primary Examiner* — James S Bergin
(74) *Attorney, Agent, or Firm* — Patsehgen IP; Moshe Pinchas

(57) ABSTRACT

The present invention describes a safe-and-arm device, mechanism or assembly (160) for a projectile (100,102) equipped with a second-stage propellant (124). The second-stage propellant (124) is ignited after the projectile has been ejected out from a launcher barrel. A lockpin (190), being urged by a spring (194), is responsive to ignition of the second-stage propellant; after the lockpin (190) and spring (194) sense and respond to the second propulsion, an unbalanced rotor (164) forming part of the safe-and-arm device or assembly (160), is released to rotate from a "safe" state to an "armed" state, as the projectile continues traveling along its trajectory to a target. In one embodiment, the projectile is configured with a 40 mm cartridge containing a first propellant (122). An impact sensor may trigger an electric
(Continued)

detonator or a point detonator may trigger a stab detonator to set off explosives disposed in the projectile.

10 Claims, 4 Drawing Sheets

(51) Int. Cl.
*F42C 15/188* (2006.01)
*F42C 15/21* (2006.01)
*F42C 15/26* (2006.01)
*F42C 15/34* (2006.01)

(58) Field of Classification Search
USPC ..... 102/231, 232, 233, 235, 237, 238, 244, 102/245, 254
See application file for complete search history.

(56) References Cited

U.S. PATENT DOCUMENTS

| | | | | |
|---|---|---|---|---|
| 3,732,825 | A | 5/1973 | Apotheloz | |
| 4,915,028 | A | 4/1990 | Apotheloz | |
| 8,082,845 | B2 * | 12/2011 | Aw | F42C 15/26 102/253 |
| 8,342,093 | B2 * | 1/2013 | Westphal | F42C 15/188 102/253 |
| 9,163,916 | B2 * | 10/2015 | Aw | F42C 15/188 |
| 2011/0203474 | A1 | 8/2011 | Westphal et al. | |

* cited by examiner

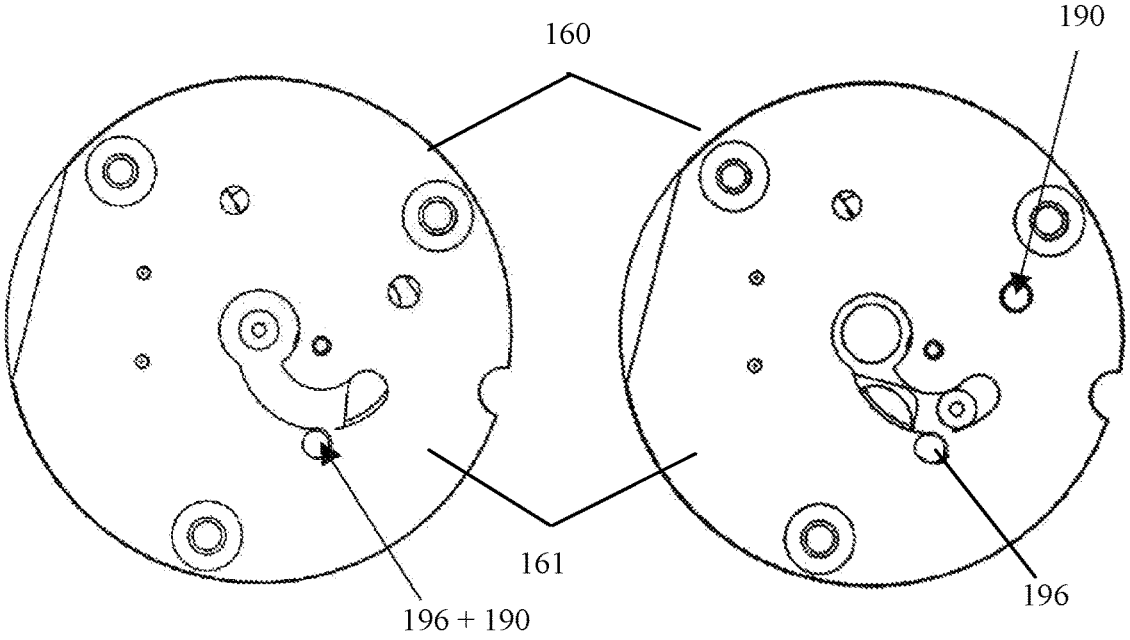
FIG. 5A
FIG. 5B
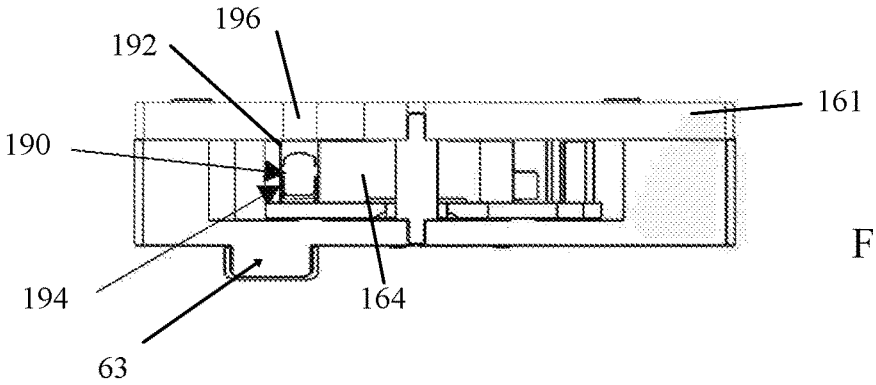
FIG 6A
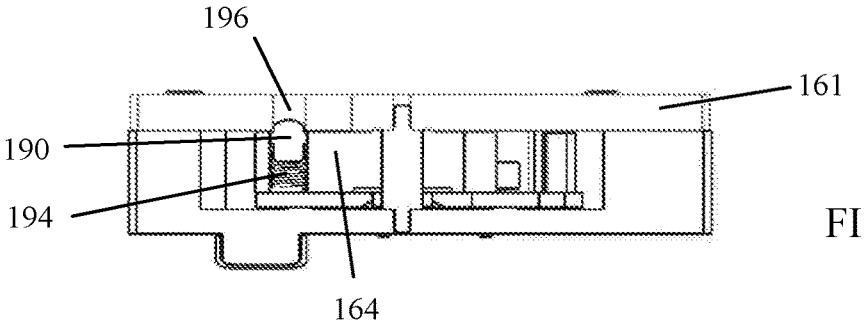
FIG. 6B
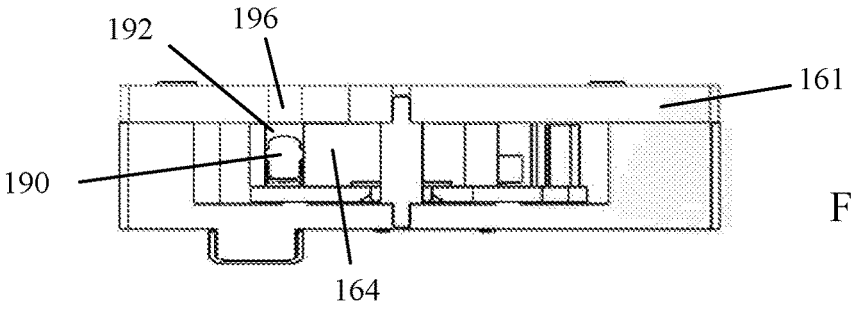
FIG. 6C

SAFE-AND-ARM DEVICE

FIELD OF INVENTION

The present invention relates to a safe-and-arm device or mechanism for a projectile equipped with a second-stage propulsion. Such a projectile is equipped with a second-stage propulsion to increase the range of projection and may be launched from a hand-held rifle.

BACKGROUND

A safe-and-arm device or mechanism is required for a munition projectile to ensure that the munition is not armed and not detonated until the projectile has been propelled to a minimum safe distance away from the launcher and conditions are safe for arming. MIL-STD-1316E requires two unique environments to be sensed before it is safe to proceed with arming of projectile.

Cartridged 40 mm projectiles are in common use, and they have the advantage of being deployable from a barrel connected to a hand-held rifle. To increase the projection distance and/or to increase the payload of the such projectiles using existing rifles, these projectiles are configured with a second-stage propulsion or ignition. It can thus be seen that there exists a need to provide another safe-and-arm device or mechanism for such a new type of projectiles.

SUMMARY

The following presents a simplified summary to provide a basic understanding of the present invention. This summary is not an extensive overview of the present invention, and is not intended to identify key features of the invention. Rather, it is to present some of the inventive concepts of this invention in a generalized form as a prelude to the detailed description that is to follow.

The present invention seeks to provide a safe-and-arm device or mechanism for a new projectile equipped with 2-stage propulsion.

In one embodiment, the present invention provides a safe-and-arm device or mechanism for a projectile equipped with 2-stage propulsion comprising: an unbalanced rotor that is configured to rotate inside the safe-and-arm device or mechanism, with a rate of rotation of the unbalanced rotor being controlled by a pinion and verge assembly; and a lockpin located on the unbalanced rotor, with the lockpin being disposed in a bore formed parallel to a longitudinal axis of the projectile, and the lockpin is being urged by a spring to extend, so that a tip of the lockpin is engaged in a locating hole formed on a cover plate that is disposed over the safe-and-arm device or mechanism; wherein, after the projectile is propelled out of a launcher barrel and the projectile is a safe distance away from the launcher barrel, a second propellant is ignited, and the projectile experiences a second acceleration force or impulse together with spin forces, the lockpin, in response to both the second acceleration and spin forces, retracts and releases the unbalanced rotor to turn, such that after a predetermined elapsed of time, the safe-and-arm device or mechanism is rotated from a "safe" state to an "armed" state, as the projectile continues on its trajectory to a target.

In another embodiment, the present invention provides a safe-and-arm sensing method in a munition projectile comprising: arranging an unbalanced rotor to rotate in a safe-and-arm assembly, with a rate of rotation of the unbalanced rotor being controlled by a pinion and verge assembly; disposing a lockpin in a bore formed on the unbalanced rotor and arranging a spring in the bore to urge the lockpin to extend, with the bore being parallel to a longitudinal axis of the munition projectile; and engaging a tip of the lockpin in a locating hole formed on a cover plate that is disposed over the safe-and-arm assembly; wherein, after the munition projectile is propelled out of an a launcher barrel and the munition projectile is subjected to both an acceleration force caused by a second-stage propulsion and spin forces, the lockpin is retracted against the spring and the unbalanced rotor, in response, is released to turn from a "safe" state to an "armed" state after the unbalanced rotor has turned through a predetermined number of rotations and an elapsed of time, as the munition projectile continues traveling along its trajectory to a target.

Preferably, the locating hole of the lockpin is of the same size as the lockpin but the lockpin has a collar to limit extension of the lockpin into the locating hole to restrain the unbalanced rotor from turning when the projectile is in the "safe" state. Alternatively, the locating hole is smaller than a diameter of the lockpin, so that a tip of the lockpin engages into the locating hole to restrain the unbalanced rotor from turning when the projectile is in the "safe" state.

Preferably, the above safe-and-arm device or mechanism comprises an electric detonator, which is operable to be set off by an impact sensor that is connected to the electronic timing module, when the projectile is in the "armed" state and the projectile impacts the target. Alternatively, the above safe-and-arm device or mechanism comprises a point detonator, which is operable to set off the stab detonator once the stab detonator is substantially aligned with the point detonator, when the projectile is in the "armed" state and the projectile impacts the target.

BRIEF DESCRIPTION OF THE DRAWINGS

This invention will be described by way of non-limiting embodiments of the present invention, with reference to the accompanying drawings, in which:

FIG. 5A illustrates a position of a lockpin at a "safe" state, whilst FIG. 5B illustrates the lockpin after the safe-and-arm device or mechanism has rotated to an "armed" state; and FIGS. 6A-6C illustrate movement responses of the lockpin when subjected to two stages of propulsion or ignitions, whilst

DETAILED DESCRIPTION

Figure 1:
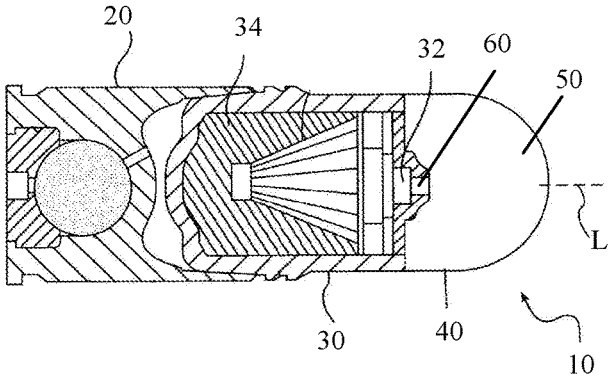
FIG. 1 (Prior Art)
FIG. 1 illustrates a conventional 40 mm cartridged projectile.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 6D:
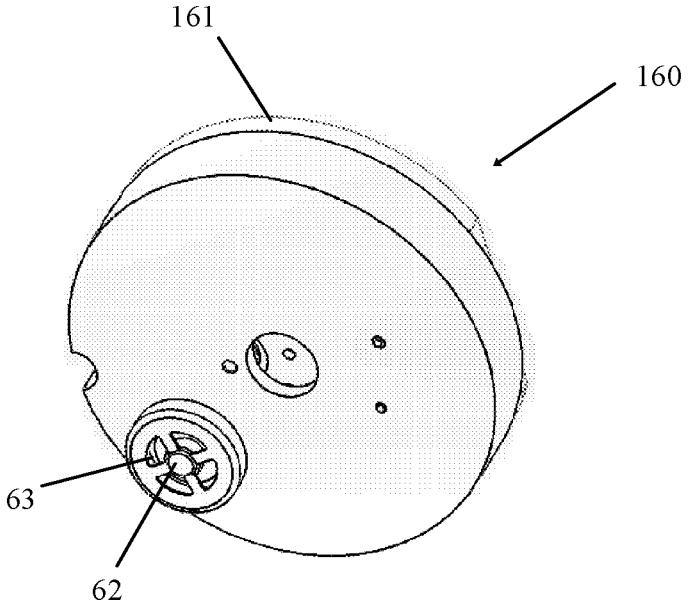
FIG. 6D illustrates location and structure of the setback pin and setback springs.

FIG. 1 shows a conventional 40 mm cartridged projectile 10. As seen from FIG. 1, the conventional cartridged projectile 10 is made up of a cartridge case 20, a body 30 and a nose cone 40, with the parts being arranged along a longitudinal axis L. A payload 50 may be disposed in the nose cone 40, whilst a safe-and-arm device assembly 60 is disposed in the nose cone 40 located aft of the payload 50. Operation of the safe-and-arm device assembly 60 is now described and with reference to FIG. 4 (illustrating both the conventional safe-and-arm device assembly 60 and a safe-and-arm device assembly 160 of the present invention): once the projectile 10 is ignited in a launcher barrel, a setback-pin 62 (as seen in FIG. 6D) experiences a first acceleration force or impulse state and, in response, the setback-pin 62 is retracted against a set of setback springs 63 (configured by leaf springs), which results in releasing of an unbalanced rotor 64. Once outside the barrel, the projectile 10 starts to spin and the unbalanced rotor 64 begins to rotate; the rate of rotation of the unbalanced rotor 64 is regulated by a pinion 66 and a verge assembly 68 so that after a predetermined number of rotations, elapsed of time, and the projectile 10 has reached a safe distance away from the launcher, the unbalanced rotor 64 is rotated from a "safe" state to an "armed" state; in the "armed" state, a stab detonator 70 on the unbalanced rotor becomes substantially aligned with an electric detonator 72. When the nose cone 40 strikes a target, electronically sensed impact forces (for eg, by means of using a shock or impact sensor) set off the electric detonator 72, which in turn, sets off the stab detonator 70. The stab detonator 70 may in turn set off a booster charge 32 or an explosive charge 34 disposed inside the body 30 of the projectile 10.

Figure 2:
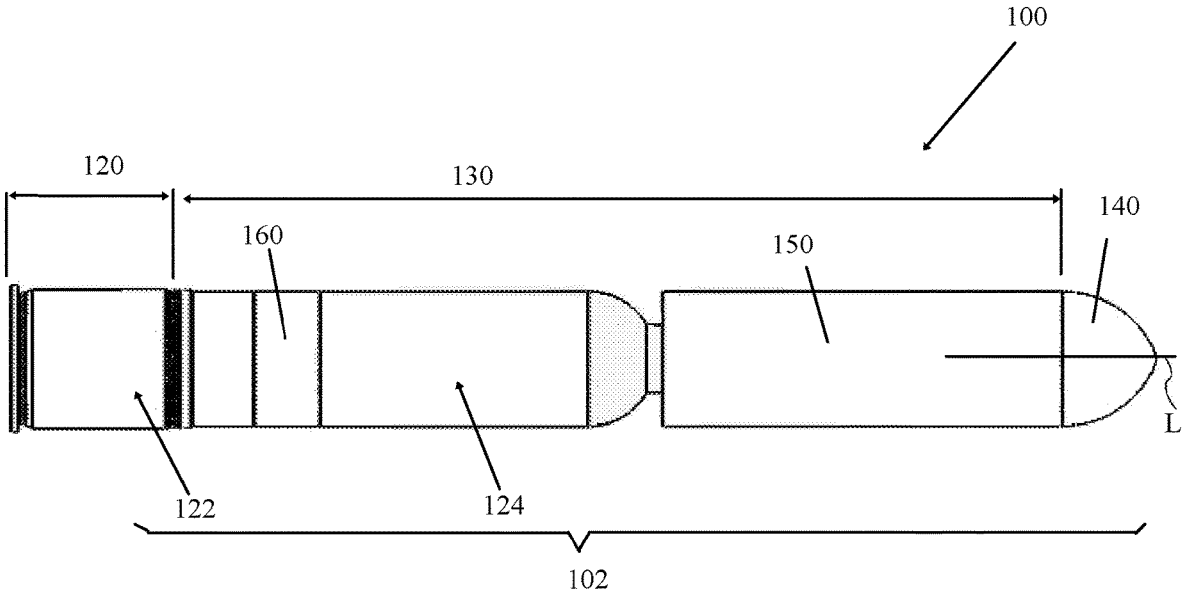
FIG. 2 illustrates a 40 mm cartridged projectile configured with 2-stage propulsion according to an embodiment of the present invention.

FIG. 2 shows a simplified diagram of a cartridged projectile 100 according to an embodiment of the present invention. The cartridged projectile 100 has corresponding parts as the conventional projectile 10, namely, a cartridge case 120 containing a first propellant 122, a projectile body 130 and a nose cone 140. A second propellant 124 is disposed in the projectile body 130. The cartridged projectile 100, including the projectile body 130 and nose cone 140, may be configured with dimensions according to a 40 mm munition type, except that the cartridged projectile 100 is longer in the longitudinal axis L. For ease of description, after the cartridge case 120 has been ejected, the projectile (ie. projectile body and nose cone) is referred to by reference number 102.

Figure 3:
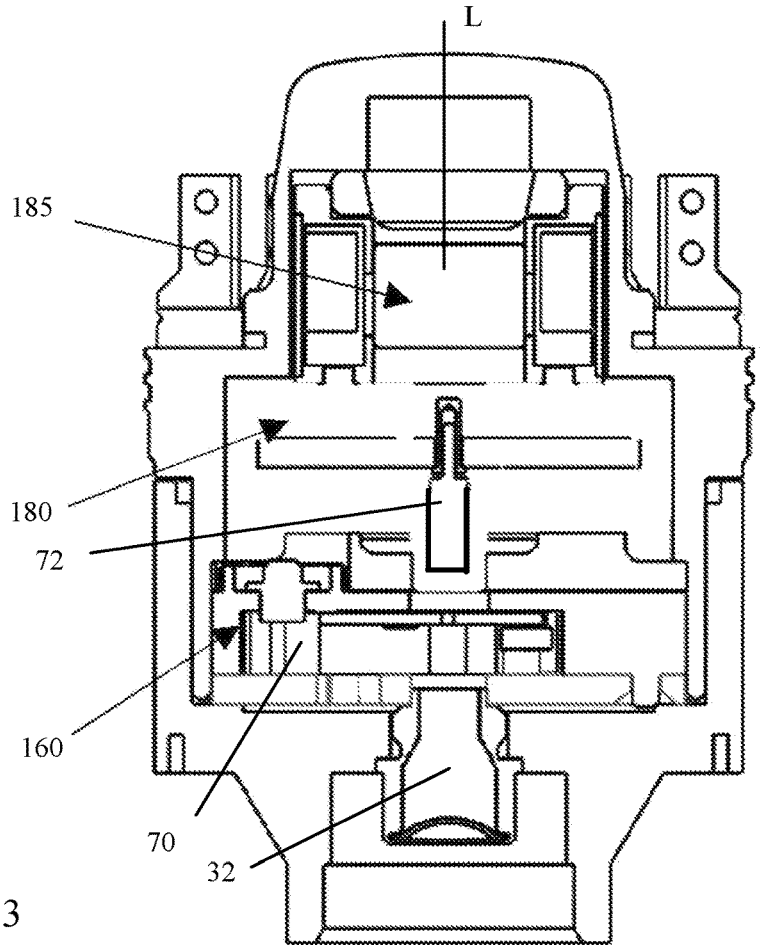
FIG. 3 illustrates a safe-and-arm device assembly for use in the projectile shown in FIG. 2, with the safe-and-arm device assembly being connected to a setback generator and an electronic timing module.

FIG. 3 shows the safe-and-arm device, mechanism or assembly 160 used in the cartridged projectile 100, projectile 102 or projectile body 130. As shown in FIG. 3, a forward end the safe-and-arm device, mechanism or assembly 160 is coupled to an electronic timing module 180 and a setback generator 185.

Figure 4:
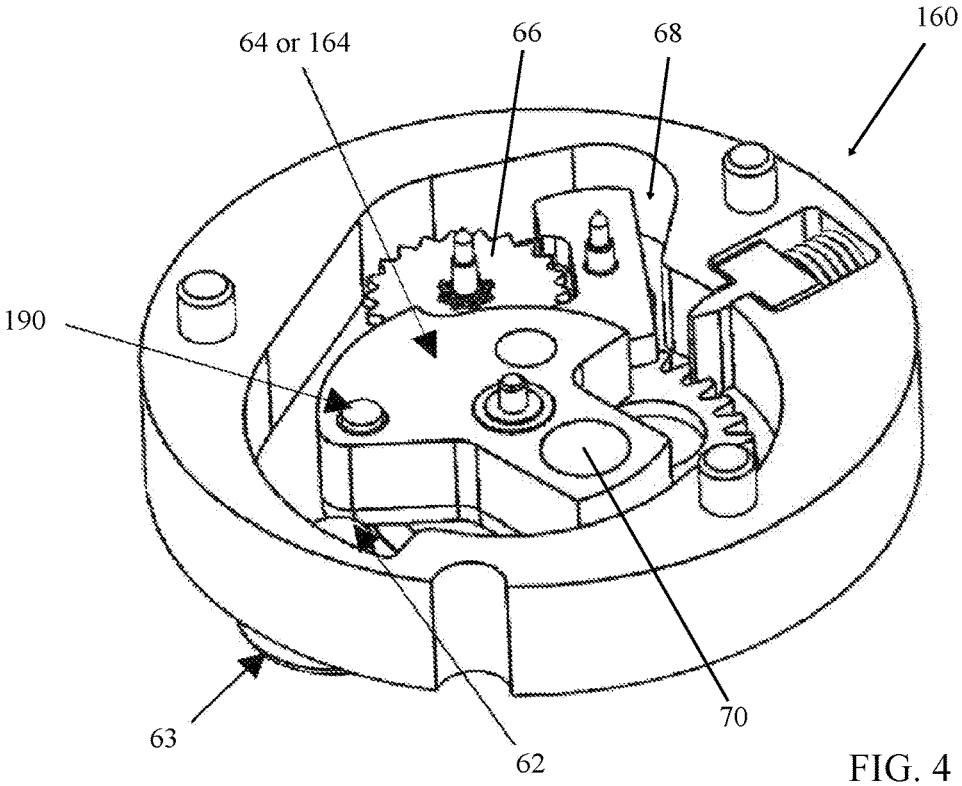
FIG. 4 illustrates interior parts of the safe-and-arm device assembly shown in FIG. 3.

Now, FIG. 4 shows part of the interior of the safe-and-arm device assembly 160. The above description of the conventional safe-and-arm device is still applicable, except that the safe-and-arm device, mechanism or assembly 160 now has a lockpin 190 located in a bore 192 formed on an unbalanced rotor 164, with the lockpin 190 and its bore being substantially parallel to the longitudinal axis L of the projectile 102. Operation of the lockpin 190 is now described with reference to FIGS. 5A-5B and 6A-6C.

FIG. 5A shows the safe-and-arm device, mechanism or assembly 160 in the "safe" state with the lockpin 190 located in the bore 192 with the lockpin 190 being urged by a spring 194; the lockpin 190 is thus being extended and engaged in a locating hole 196 formed in a plate 161 that covers the safe-and-arm device, mechanism or assembly 160; the plate 161 is part of a body of the safe-and-arm device or assembly 160 and is thus stationary with respect to the unbalanced rotor 164.

As seen from FIG. 6A, the locating hole 196 is smaller in diameter than the lockpin 190, so that a tip of the lockpin 190 is engaged in the locating hole 196 to prevent the unbalanced rotor 164 from turning. It is also possible that the locating hole 196 has a step or is conical. It is also possible that the locating hole 196 receives the tip of the lockpin 190 with the lockpin 190 having a collar to limit the extension of the lockpin 190 into the locating hole 196, as seen in FIG. 6B. When the cartridged projectile 100 is ignited in the launcher barrel and experienced a first acceleration force or impulse, the projectile 102 is propelled out of the barrel, and both the setback pin 62 and the lockpin 190 become retracted in their respective bores. The projectile 102 experiences the first acceleration force or impulse only momentarily; as a result, the spring 194 pushes the lockpin 190 back into the locating hole 196 and prevents the unbalanced rotor 164 from rotating, ie. the projectile 102 remains in the "safe" state. Once the projectile 102 is outside the launcher barrel, the projectile 102 experiences spin forces but the safe-and-arm device or assembly 160 remains in the "safe" state, as seen in FIGS. 5A and 6B. With the present invention, both the setback pin 62 and the lockpin 190 provide a double-safety feature, where both the setback pin 62 and the lockpin 190 ensure safe mechanical handling of the cartridged projectile 100.

Shortly after the projectile body 102 is ejected outside the launcher barrel, for eg. 2 m away, the second-stage propellant 124 is ignited; the lockpin 190 then experiences a second acceleration force, together with spinning forces; in response to the second acceleration force, the lockpin 190 retracts and releases the unbalanced rotor 164; in other words, the lockpin 190 is retracted from the locating hole 196 and the unbalanced rotor 164 becomes free to rotate in response to the second acceleration and spinning forces, but under control by the opinion 66 and verge assembly 68. After a predetermined number of rotations and elapsed of time, the projectile 102 is propelled to a safe distance away along its trajectory to a target and the unbalanced rotor 164 is being rotated from the "safe" state into an "armed" state, as seen in FIG. 5B. The lockpin 190 is provided to ensure sensing of the second ignition or second propulsion before arming can take place. In other words, the double-safety feature is to ensure that the setback pin 62 satisfies the mandatory safe handling requirement of the cartridged projectile 100, whilst the lockpin 190 provides a means for sensing the second ignition of the propellant 124. In the "armed" state, the stab detonator 70 on the unbalanced rotor 164 becomes substantially aligned with the electric detonator 72. As the projectile 102 continues on its trajectory to its target, and when the nose cone 140 strikes the target, electronically-sensed impact forces (for eg, by means of using a shock or impact sensor connected to the electronic timing module) set off the electric detonator 72, which in turn, sets off the stab detonator 70; alternatively, it is also possible that the impact forces thrust the safe-and-arm device or assembly 160 forward and a pointdetonator (not shown in the figures) then sets off both the stab detonator 70 and a chain of explosive charges.

While specific embodiments have been described and illustrated, it is understood that many changes, modifications, variations and combinations of variations disclosed in the text description and drawings thereof could be made to the present invention without departing from the scope of the present invention. For example, the electronic timing module 180 may be configured so that when the impact forces fail to trigger the electric detonator 72 or the stab detonator 70, a self-destruct signal is sent to the electric detonator to trigger self-destruction of the projectile body; it is also possible that the electronic timing module 180 is additionally configured with an electronic impact sensing circuit to generate an impact signal to trigger the electric detonator when mechanical impact fails to trigger the stab detonator 70. A more complex system of electronically controlling the impact firing signal can also be adopted as disclosed by the Applicant in U.S. Pat. No. 9,163,916.

The invention claimed is:

1. A safe-and-arm device or mechanism for a projectile equipped with 2-stage propulsion comprising:

an unbalanced rotor that is configured to rotate inside the safe-and-arm device or mechanism, with a rate of rotation of the unbalanced rotor being controlled by a pinion and verge assembly; and a lockpin located on the unbalanced rotor, with the lockpin being disposed in a bore formed parallel to a longitudinal axis of the projectile, and the lockpin is urged by a spring to extend, so that a tip of the lockpin is engaged in a locating hole formed on a cover plate that is disposed over the safe-and-arm device or mechanism;

wherein, after the projectile is propelled out of a launcher barrel and the projectile is a safe distance away from the launcher barrel, a second propellant is ignited, and the projectile experiences a second acceleration force or impulse together with spin forces, the lockpin, in response to both the second acceleration and spin forces, retracts and releases the unbalanced rotor to turn, such that after a predetermined elapsed of time, the safe-and-arm device or mechanism is rotated from a "safe" state to an "armed" state, as the projectile continues on its trajectory to a target.

2. The safe-and-arm device or mechanism according to claim 1, further comprising a setback generator to supply electric power to an electronic timing module disposed adjacent to the safe-and-arm device.

3. The safe-and-arm device or mechanism according to claim 2, further comprising an electric detonator, which is operable to be set off by an impact sensor that is connected to the electronic timing module, when the projectile is in the "armed" state and the projectile impacts the target.

4. The safe-and-arm device or mechanism according to claim 1 wherein the locating hole is of the same size as the lockpin but the lockpin has a collar to limit extension of the lockpin into the locating hole to restrain the unbalanced rotor from turning when the projectile is in the "safe" state.

5. The safe-and-arm device or mechanism according to claim 1 wherein the locating hole is smaller than a diameter of the lockpin, so that a tip of the lockpin engages into the locating hole to restrain the unbalanced rotor from turning when the projectile is in the "safe" state.

6. The safe-and-arm device or mechanism according to claim 5, wherein the locating hole is stepped or conical.

7. The safe-and-arm device or mechanism according to claim 1, further comprising a point detonator, which is operable to set off a stab detonator once the stab detonator is substantially aligned with the point detonator, when the projectile is in the "armed" state and the projectile impacts the target.

8. A safe-and-arm sensing method in a munition projectile comprising:

arranging an unbalanced rotor to rotate in a safe-and-arm assembly, with a rate of rotation of the unbalanced rotor being controlled by a pinion and verge assembly;

disposing a lockpin in a bore formed on the unbalanced rotor and arranging a spring in the bore to urge the lockpin to extend, with the bore being parallel to a longitudinal axis of the munition projectile; and engaging a tip of the lockpin in a locating hole formed on a cover plate that is disposed over the safe-and-arm assembly;

wherein, after the munition projectile is propelled out of an a launcher barrel and the munition projectile is subjected to both an acceleration force caused by a second-stage propulsion and spin forces, the lockpin is retracted against the spring and the unbalanced rotor, in response, is released to turn from a "safe" state to an "armed" state after the unbalanced rotor has turned through a predetermined number of rotations and an elapsed of time, as the munition projectile continues traveling along its trajectory to a target.

9. The safe-and-arm sensing method according to claim 8, further comprises sensing an impact using an electronic impact sensor connected to an electronic timing and sensing module when the munition projectile is in the "armed" state, so that an output signal of the electronic impact sensor impacting the target is used to set off an electric detonator, which in turn triggers a chain of explosives disposed in the munition projectile.

10. The safe-and-arm sensing method according to claim 8, further comprises thrusting a stab detonator onto a point detonator when the munition projectile is in the "armed" state, so that setting off of the stab detonator triggers a chain of explosives disposed in the munition projectile.

* * * * *